United States Patent [19]

Serio

[11] Patent Number: 5,029,724

[45] Date of Patent: Jul. 9, 1991

[54] LOCKING MECHANISM FOR CONTAINER LID

[76] Inventor: Joseph L. Serio, 1503 West St., Apt. B, Annapolis, Md. 21401

[21] Appl. No.: 465,328

[22] Filed: Jan. 16, 1990

[51] Int. Cl.[5] ..... B65D 45/04

[52] U.S. Cl. ..... 220/322; 220/908

[58] Field of Search ..... 220/315, 318, 322, 323, 220/210, 1 T, 314, 324, 908, 909, 342, 343, 375

[56] References Cited

U.S. PATENT DOCUMENTS

| | | | |
|---|---|---|---|
| 629,977 | 8/1899 | Barber | 220/315 X |
| 1,424,816 | 8/1922 | Grillone | 242/71.1 |
| 1,499,919 | 9/1922 | Friend | 220/315 X |
| 1,802,557 | 4/1931 | Hight | 220/322 X |
| 2,098,858 | 9/1936 | Busson et al. | 220/322 |
| 3,530,778 | 9/1970 | Conner et al. | 220/315 X |
| 4,182,530 | 1/1980 | Hodge | 294/73 |
| 4,520,945 | 6/1985 | Hodge | 220/315 |

FOREIGN PATENT DOCUMENTS

| | | | |
|---|---|---|---|
| 1042469 | 10/1958 | Netherlands | 220/318 |

*Primary Examiner*—Gary E. Elkins
*Assistant Examiner*—Stephen K. Cronin
*Attorney, Agent, or Firm*—Longacre & White

[57] ABSTRACT

The invention is directed to a locking mechanism for a container having a hinged or removable lid. The elements of the locking mechanism comprise a U-shaped securing member which is attached to the sidewalls of the container. The U-shaped member pivots over the lid, and is held in place by a lock mechanism. The locking mechanism may either fix the U-shaped securing element directly to a locking lug on the container sidewall, or may be attached to the locking lug via a securing strand element.

6 Claims, 1 Drawing Sheet

FIG. 1
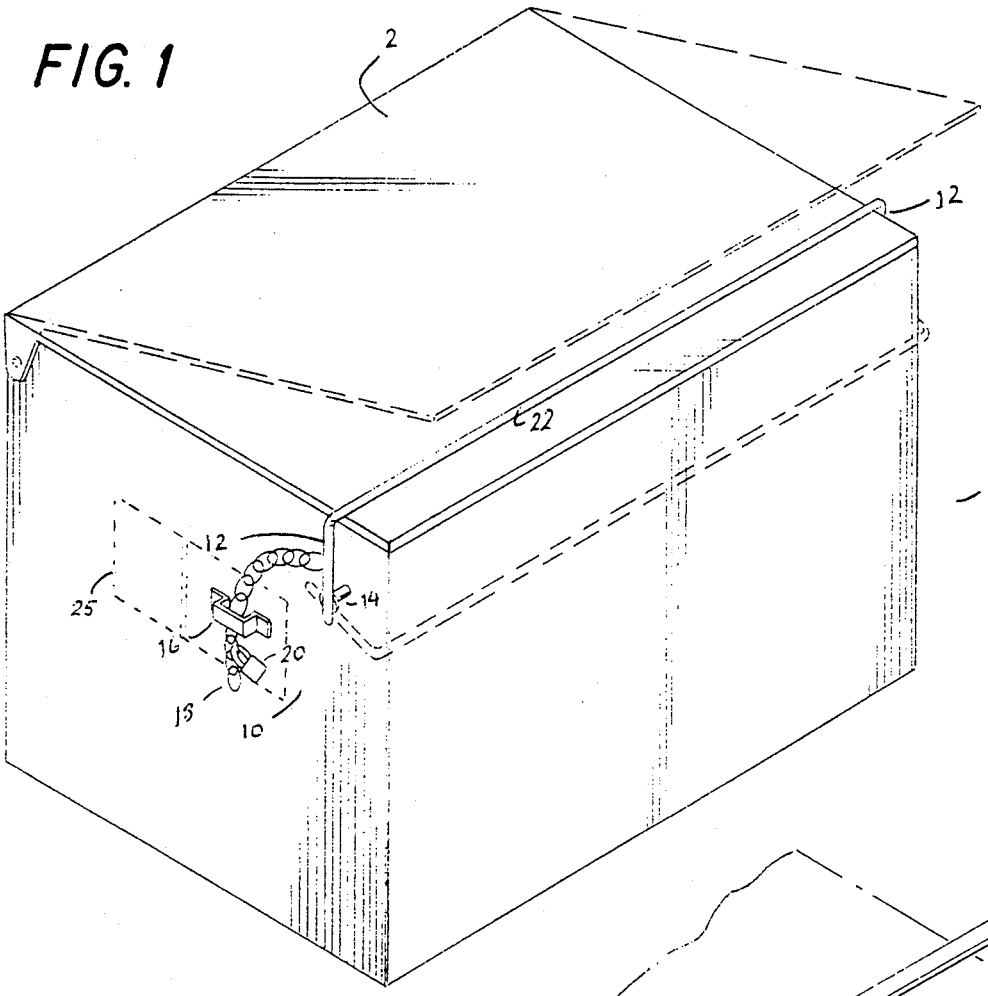
FIG. 2
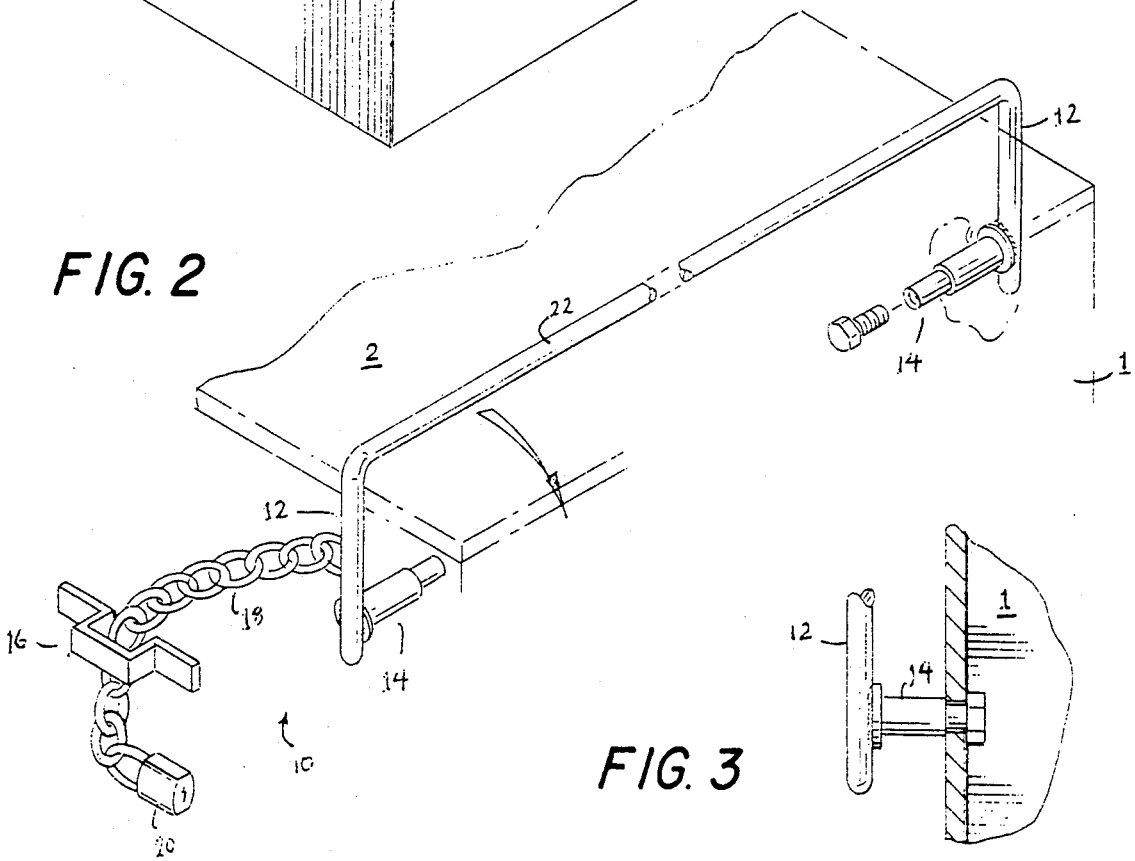
FIG. 3

LOCKING MECHANISM FOR CONTAINER LID

FIELD OF THE INVENTION

The present invention relates to the field of locking mechanisms for container lids. Specifically, the invention relates to a pivoting locking mechanism for locking in place the access openings of plastic lidded containers.

BACKGROUND OF THE INVENTION

Many container lid locking mechanisms have been proposed. An example of a container lid locking system is disclosed in U.S. Pat. 4,534,488. While the many prior art container lid locking mechanisms have their uses, several shortcomings have become evident with respect to efficiently and effectively locking lids on large containers. Specifically, in the field of locking container lids for trash receptacles, there are few simple locking mechanisms, and even fewer retrofit mechanisms which can be applied to a broad variety of types and sizes of containers.

With the advent of mechanized trash removal, there have been created a number of large sized trash bins. These bins usually comprise a block shaped container with a hinged lid attached to one side thereof. The container further includes attachments for accommodating various forked lifting mechanisms of the trash removal vehicle. The containers are lifted by the lifting mechanism of the trash removal vehicle and pivoted in some fashion so that the hinged top of the container opens and the trash contained therein is emptied into the vehicle. The container is then returned to a position on the ground, and the hinged lid closes on top of the container.

Many of these large trash receptacles are rented from the trash removal service. These receptacles are not provided free of charge, and consequently their frequent emptying and service are sometimes a considerable expense. This expense is increased when unauthorized users of the receptacle freely deposit trash therein. This unauthorized use necessitates a more frequent emptying of the container, and of course the unauthorized user does not contribute to the increased expense.

For the foregoing reasons, there has existed a need to create a locking mechanism for these containers which is simple and reliable, and which can be originally and retrofitted to a broad variety of containers. While many of these containers are of all metal construction, and at that very fairly heavy gauge metal, many of the newer containers are of partial plastic construction or are of all plastic construction. Hence, the ability for a user or provider of the receptacle to attach a simple welded locking structure is limited owing to the fact that not all of the parts of the container can accommodate a weld.

Another problem of retrofitting existing containers or providing a broad application type of locking mechanism for variously sized containers is the question of custom sizing application. The solution to accommodating a broad size of containers is to create a locking mechanism which can be changed in dimension while not altering the basic operation of the locking mechanism.

The present invention seeks to obviate the shortcomings of the prior art container lid locking mechanisms, while at the same time providing a solution to the need for a retrofit locking mechanism for a wide variety of container types, materials, and sizes.

SUMMARY OF THE INVENTION

The present invention comprises only a few basic elements which in combination serve to securely lock in place a removable or hinged container lid to a container. The elements of the lock comprise a U-shaped securing element which pivots over the top of the container lid from the side portions of the container. The securing element is then locked in place by either a security strand or chain to a loop element which is attached to an outside surface of the container—or, on containers with side doors, to that door.

The securing element can pivot on supporting pin elements which are attached to the sidewalls of the container. The pin elements can be either welded to the sidewalls of the container if the container is metal, or can be bolted through the sidewall of the container if the container is unable to take a weld. The securing lug element can also be similarly bolted or welded depending on the nature of the container.

The locking mechanism can accommodate a variety of sizes of containers owing to the fact that the only portion which must change dimension is the element which extends over the top of the lid of the container.

These and other objects of the invention will become apparent to one of skill in this art upon the reading of the following detailed description along with the accompanying drawings which form a part thereof.

BRIEF DESCRIPTION OF THE DRAWINGS

FIG. 1 is a perspective view of a container equipped with a locking mechanism according to the present invention.

FIG. 2 is a close-up perspective view of the elements of the locking mechanism.

FIG. 3 is a sectional view of the sidewall of a container equipped with the pivoting pins according to the present invention.

DETAILED DESCRIPTION OF THE PREFERRED EMBODIMENT

FIG. 1 shows a container including a hinging lid which is equipped with a locking mechanism according to the present invention. The container 1 includes a hinging lid 2, which lid hinges from a rearward portion of the container. Although this particular container shows that the lid of the container is hingable, a totally removable container lid may also be withheld by the locking mechanism according to the present invention.

The elements of the locking mechanism will now be described with particular reference to FIGS. 1 and 2.

The locking mechanism includes a U-shaped securing element. The securing element comprises a connecting bar 22, and a pair of pivoting attaching members 12 connected to each end thereof.

The securing element is pivoted to the sidewalls of the container by pivot supports 14. These supports may comprise either bolts or welded pins, depending on the type of the container and the necessary support requirements. If the container is of non-metallic construction, the fitting of the pivot supports 14 can be accomplished by hole drilling and bolting to the container. If the container is comprised of a metallic material, which can accommodate a weld, a simple welded post may comprise pivot support 14.

The securing element is rotatable between an unlocked and locked configuration. The locked configuration is shown in solid line configuration in both FIGS. 1 and 2. The unlocked configuration is shown by dashed lines in FIG. 1.

To secure the securing element in a locked condition, a securing strand or chain 18 is fastened approximately midway along one or both of the pivoting attaching members 12. This securing strand 18 may be of any length, and may in fact be so abbreviated as to merely comprise a loop on the pivoting attaching member 12.

The securing strand 18 cooperates with a securing lug 16 so as to hold the securing element in a locked configuration.

The lug 16 may be either bolted or welded to the container to the nature of the material of the container. The function of the securing lug 16 is merely to provide a securing element to attach the securing strand 18 fixedly thereto.

The securing strand 18 and locking lug 16 may be directly locked one to the other, or include a locking device such as the padlock 20 shown in the drawing figures. The padlock, or other locking device, may lock the securing strand 18 and locking lug 16 directly to each other, or may be secured to the securing strand 18 after it has been inserted through a loop type of locking lug 16.

The locking lug 16 may take the form of a handle which can be included on the customary sliding doors 25 of large trash receptacles. These doors 25 are shown in dashed configuration in FIG. 1. In this way, the locking of the locking mechanism 10 serves to also secure in the closed position the sliding doors 25.

FIG. 3 shows how the pivoting support 14 is inserted into and through a container sidewall. The pivoting attaching member 12 is fixed to the pivot support 14. Although the drawing figure shows the pivot support in a bolted configuration, the same objective may be accomplished by using a welded attachment. If a welded attachment is used, the pivoting attaching member 12 would pivot about the pivot support 14, as opposed to having the pivot support 14 pivot within the sidewall of the container.

The locking mechanism 10 according to the present invention is intended to fit a variety of containers having removable or hingeable lids. These containers may be of all metal, metal-plastic, or plastic construction. The locking mechanism 10 may be provided as original equipment on the container, or may be retrofitted with the locking mechanism at the manufacturing facility or in the field.

Further variations of the present invention will occur to those skilled in the art, and the claims listed below are not in any way intended to limit the scope of this invention.

I claim:

1. The combination of a pivoting locking mechanism and a container having a pair of opposing sidewalls, a bottom, and a movable container lid, comprising:

a U-shaped locking bar, including a pair of pivoting attaching elements and a connecting bar portion therebetween;

a pair of pivot supports, each pivot support being mounted on a respective one of the opposing sidewalls of said container and being fastened to a respective one of the pivoting attaching elements of said U-shaped locking bar, thereby pivotally supporting said U-shaped locking bar;

a first securing member attached to said U-shaped locking bar comprising a strand element;

a second securing member attached to an outside surface of said container; and, locking means for locking said first securing member to said second securing member; wherein, when said U-shaped locking bar is pivoted so that said container lid is located between said connecting bar portion and the sidewalls of said container, and said locking means is positioned to lock said first securing member to said second securing member, said container lid is thereby locked in place.

2. A combination as in claim 1, wherein:

said first securing member comprises a length of chain.

3. A combination according to claim 2, wherein:

said second securing member comprises a loop attached to said outside surface of said container.

4. A combination as recited in claim 1, wherein:

said second securing member comprises a loop attached to said outside surface of said container.

5. A combination as recited in claim 1, wherein:

said container is of all metal construction.

6. A combination as recited in claim 1, wherein:

said sidewalls and bottom of said container are of all metal construction and said movable container lid is of non-metal construction.

* * * * *